US005222281A

United States Patent [19]

Guérin

[11] Patent Number: 5,222,281

[45] Date of Patent: Jun. 29, 1993

[54] MOLDED COFFIN

[76] Inventor: André J. Guérin, 1841, Lamountain Nord, Alma, Quebec, Canada, G8B 4X9

[21] Appl. No.: 820,798

[22] Filed: Jan. 15, 1992

[51] Int. Cl.[5] ..... A61G 17/00

[52] U.S. Cl. ..... 27/7; 27/10

[58] Field of Search ..... 27/2, 6, 7, 10, 3

[56] References Cited

U.S. PATENT DOCUMENTS

| | | | |
|---|---|---|---|
| 76,344 | 4/1968 | Potter et al. | 27/10 |
| 202,470 | 4/1878 | Richey | 27/10 |
| 2,392,298 | 1/1946 | Thommen | 27/2 |
| 2,494,473 | 1/1950 | Dowling | 27/3 |
| 4,800,631 | 1/1989 | Pellmann | 27/7 |
| 4,930,197 | 6/1990 | McClive | 27/7 |

FOREIGN PATENT DOCUMENTS

| | | | |
|---|---|---|---|
| 372540 | 3/1923 | Fed. Rep. of Germany | 27/10 |

*Primary Examiner*—Richard E. Chilcot, Jr.
*Attorney, Agent, or Firm*—Roland L. Morneau

[57] ABSTRACT

A water and weather resistent coffin is made of a layer of hardened plastified fiber mat and a second layer made of hardened end-grain balsa core panel. The side walls of the coffin are connected to the bottom wall by a pair of squares along each side wall. The squares are formed of narrow plates connected to each other by a triangeloid linking plate. The cover and the box of the coffin have a corresponding perimeter separated by a sealing strip. The cover is hingedly mounted on the box and is adapted to be locked to squeeze the sealing strip. The great resistence of the material used and its structure allows the lateral walls of the box of the coffin to remain straight when a cadaver lies on the bottom wall. The walls of the coffin are flat to maintain a light weight and their original shape under normal stress.

12 Claims, 3 Drawing Sheets

MOLDED COFFIN

BACKGROUND OF THE INVENTION

1. Prior Art

Burial vaults made of fiberglass or plastic are known. In order to increase the rigidity of such vaults, multiple reinforcing ribs are provided on their surface. Such a structure is found in U.S. Pat. No. 3,159,901 and Canadian patent Nos. 722,356 abd 1,106,160. U.S. Pat. No. 3,545,055 is directed to a coffin having a peripheral outer L-shaped flange provided with apertures for holding the coffin. The flange is essentially intended as a reinforcing rib. The bottom wall is reinforced by a corrugated design. Because the shape of the coffin can vary and particularly the side walls can curve when a cadaver lies on the bottom wall, the cover is provided with a peripheral L-shaped edge to hold the sidewalls from curving. As stated in column 3, line 10, the extension 27 rests in the trough 23 when the cover is opened and this trough extension acts as a hinge for the cover. Such an arrangement does not show nor allow the installation of actual hinges on the sidewall per se and consequently does not allow the sealing and locking with a padlock.

SUMMARY OF THE INVENTION

The invention is directed to a light weight coffin including a box, a hingedly mounted cover having a periphery corresponding to the periphery of the box and at least two handles on each side of the box for carrying the latter. The box is made of a flat bottom wall, flat lateral walls and two flat end walls. The walls are particularly made of a first layer of a hardened plastified fiber mat and a second layer inside the first layer made of hardened end-grain balsa core panel, a pair of squares secured to each lateral wall and to an adjacent portion of the bottom wall. The squares are spaced from each other and adapted to maintain the angular relationship between the lateral walls and the bottom wall and accordingly to maintain a predetermined periphery for the box. The rigidity of the walls combined with the squares are adapted to maintain the correspondence of the periphery of the box and of the cover when the cadaver is lying in the box.

The walls are particularly made of fiberglass reinforced with polyester and the balsa layer is reinforced with a polyester or an epoxy resin.

The squares particularly include a thin linking plate having a concave contour for allowing maximum inner space for the cadaver.

The cover is connected to the box by a pair of hinges secured along the upper edge of one of the lateral walls and adapted to be partly hidden when the cover is closed. A padlock is used on the wall opposite the hinges for tightly closing the coffin by a seal disposed between the upper edge of the box and the peripheral edge of the cover.

DETAILED DESCRIPTION OF THE INVENTION

Figure 1:
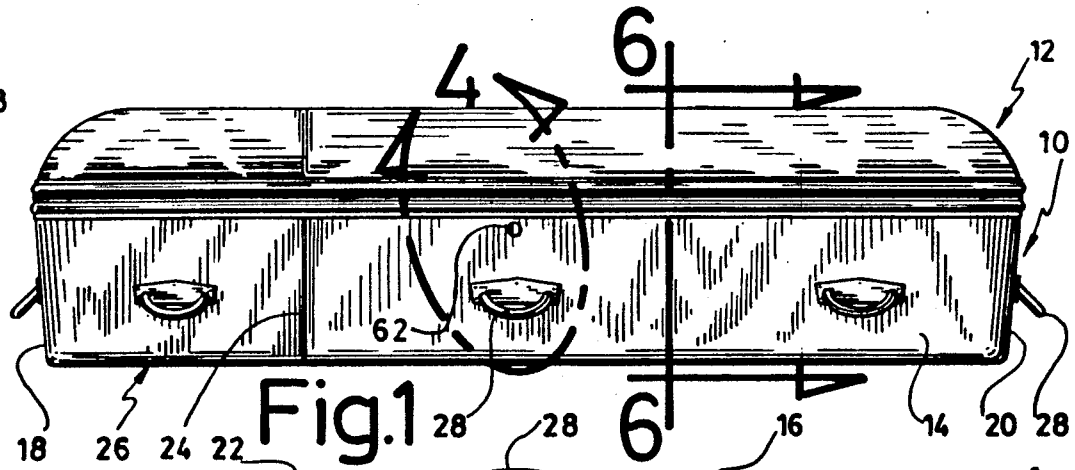
FIG. 1 is a side view of the coffin according to the invention.
Figure 2:
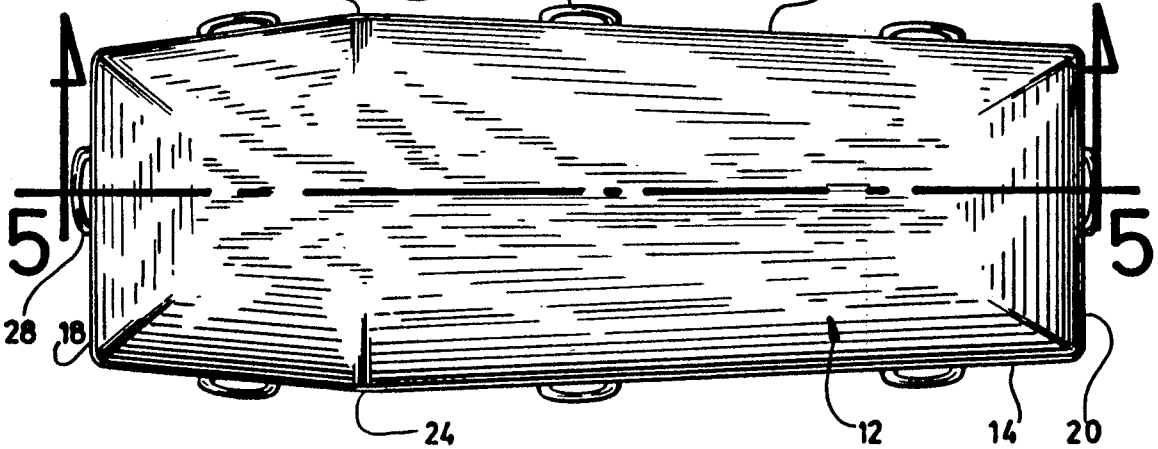
FIG. 2 is a top view of the coffin shown in FIG. 1.
Figure 3:
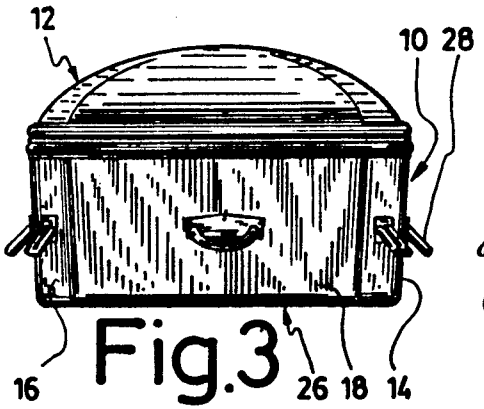
FIG. 3 is a end view of the coffin.
Figure 4:
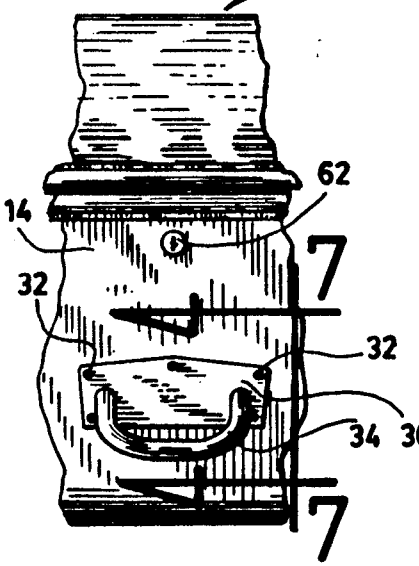
FIG. 4 is an enlarged detailed view of encircled portion 4 shown in FIG. 1.

FIGS. 1, 2 and 3 show an outer view of the box 10 and the cover 12 forming the coffin. The box 10 is made of two end walls 18 and 20. The lateral walls 14 and 16 are preferably angularly shaped forming an apex at intersections 22 and 24. Such angular shape provides additional strength to the box while providing the proper location for the needed width of the torso and shoulders and for reducing the width of the coffin at both ends. The lateral and the end walls are substantially perpendicular to the bottom wall 26. The cover 12 is arched shaped along the longitudinal axis of the coffin. Each lateral wall 14 and 16 is provided with three handles and each end wall is provided also with a handle. The handle secured to the end walls 18 and 20 are added to facilitate the manipulation of the coffin in certain circumstances. An enlarged view of a handle is shown in FIG. 4 which consists of a plate 30 secured to the lateral wall with the screws 32. A hook-shaped member 34 is secured to the plate and extends outwardly in a slightly downward direction.

The box 10 is essentially made of two adhesively connected layers 36 and 38. The first layer is made of a hardened plastified fiber mat usually referred as fiberglass and the second layer is made of a hardened end-grain basla core panel. The two layers are adhesively connected by the resin used to harden the fiberglass and the end-grain balsa.

As it will be explained later, the fiberglass layer is made of a piece of fibre textile covered with a liquified polyester mixed with a hardener. The balsa panel which is about one half inch thick is similarly covered with a liquified polyester mixed with a hardener. The two layers form a box 10 which is extremely strong, waterproof, non-corrosive and which can last longer than wood or metal coffins against all sorts of weather and ground conditions. Another advantage of the new composition of material is that it is lighter than wood and metal.

The composition of the two layers described for making the box 10 is also used for making the cover 12 that is with a fiberglass layer 40 balsa panel 42.

Figures 5, 7, 8, 9:
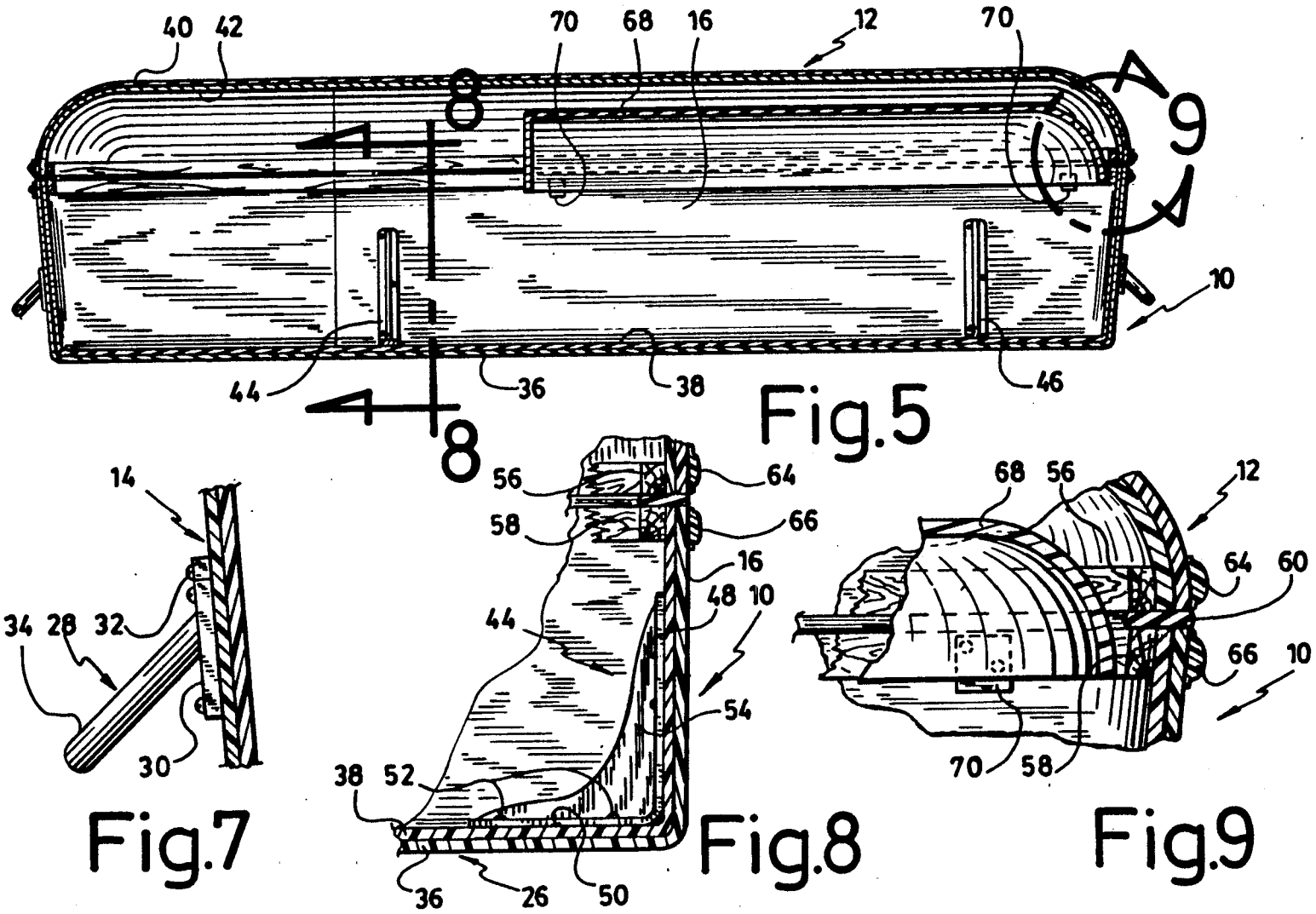
FIG. 5 is a cross-sectional view of the coffin taken along line 5—5 of FIG. 2.
FIG. 7 is a side view of one handle along line 7—7 of FIG. 4.
FIG. 8 is a cross-sectional view along line 8—8 of FIG. 5.
FIG. 9 is an enlarged view of encircled portion 9 of FIG. 5.
Figure 6:
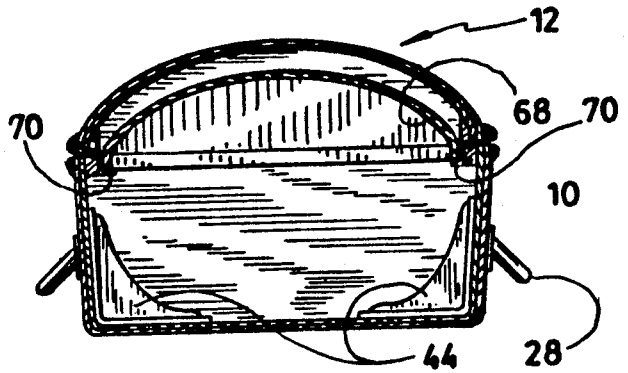
FIG. 6 is a cross-sectional view taken along line 6—6 of FIG. 1.

As seen in FIGS. 5, 8 and 9, the upper edge of the peripheral walls of the box 10 corresponds to the periphery of the lower edge of the cover 12. In order to maintain this correspondence, a pair of squares 44 and 46 is secured between each lateral walls 14 and 16 and the bottom wall 26. The squares 44 and 46 are intended to reinforce the angular relationship between the sidewall or lateral wall 16 and the bottom wall 26. Any change in the angle between the lateral walls and the bottom wall could produce a change in the periphery of the upper edge of the lateral walls 14 and 16. The squares 44 and 46 are preferably narrow so as not to cramp the cadaver. For this reason, the squares are made of two flat plates 48 and 50 respectively secured to the lateral wall 16 and the bottom wall 26 by screws such as 52 and by a linking plate 54 which has a trianguloid shape and preferably defining a concave curve for the purpose intended. The squares 44 and 46 are made of metal. Depending on the reinforcing strength desired, the height of the flat plate 48 extends to about ⅔ of the height of the side wall which may vary between 5 to 12 inches. The flat plate 50 extending over the bottom wall 26 extends over the surface of the bottom wall 26 to about ⅓ of its width. Such dimensions are combined with the rigidity of the flat walls is expected to support the weight of any cadaver without any substantial change in the shape of the side walls.

Considering that the cover 12 and the box 10 are meeting edgewise around their periphery, it is possible to install a set of hinges 54 between the upper edge of the lateral wall 16 and the lower edge of the cover 12. The installation of the hinges 54 is facilitated by a strip of wood 56 interiorly mounted adjacent the lower periphery of the cover 12 and a second strip of wood 58 interiorly secured to the upper edge of the peripheral walls formed by the lateral walls 14 and 16 and the end walls 18 and 20. A seal 60 made of resilient rubber is fixed to the lower edge of the cover and is intended to make the coffin air tight and water tight when the cover 12 is closed over the box 10. In order to maintain such seal, a lock is mounted on the wall 14 opposite the wall provided with the hinges 54 for tightening the seal 60 between the cover and the box 10.

Considering that the upper edge of the periphery of the box 10 is built to abut against the lower edge of the periphery of the cover 12, a pair of decorative strips 64 and 66 are fixed on the outer periphery of the box 10 and the cover 12 adjacent the aforementioned edges. In addition of being decorative, the strips are intended to hide the meeting line between the box 10 and the cover 12 particularly when the cover doesn't fall completely flush with the box 10. Such discrepancies may be expected considering that the tolerances for making coffins does not require high precision.

A second cover 68 is also provided in the coffin to cover part of the cadaver when the body lay in state. The cover 68 is supported by a pair of right angular bracket 70 along each of the lateral walls 14 and 16 and in particular on the strip 58.

The box 10 as well as the cover 12 are similarly made according to the same method. In the case of the box 10, a mold defining the outer contour of the box is used. In order to obtain an aesthetic finish a layer of isophthalic resin is sprayed on the inner surface of the mold. Such resin which is generally referred to as gelcoats which cures to a tough, glossy finish. Such coat is water resistant and has weathering properties. The gelcoat is also used to fill the asperities between the mold and-the first layer made of fiberglass.

The fiberglass layer 36 is obtained by stretching a fiber mat on a flat surface and by impregnating it with a curable resin such as epoxy or polyester. Air bubbles which may be formed in the resin are removed by a roller. The impregnated mat is subsequently deposited inside the mold over gelcoat. Before the resin covering the fiber mat has completely hardened, panels of end-grain balsa are deposited over the unhardened resin. A second layer of curable resin such as epoxy or polyester is deposited over the balsa panel and spread evenly. Both layers of resins are allowed to completely dry and harden to obtain a finished box which has a rigidity compared to a metal box.

The end-grain balsa core used for this purpose is about half an inch thick. The description of end-grain balsa may be found in an article by K. A. Feichtinger entitled "Test Methods and Performance of Structural Core Materials". This article has been published in the 4th annual ASM International/Engineering Society of Detroit-Advance Composites Conference/Exposition, Sep. 13–15, 1988.

The wooden strips 56 and 58 are subsequently glued to the box and to the cover. Subsequently, the squares 44 and 46 and the brackets 70 are fixed inside the box with screws such as 52. The combination of the two layers of fiberglass with balsa allows the threaded screws to solidly hold the squares 44 and 46 and the brackets 70 solidly to the box. Similarly, the handles 28 are secured to the oputside of the box, that is, on the lateral panels 14 and 16 with screws 32. The same applies to the handle 28 mounted on the end walls 18 and 20.

A lock 62 is mounted through the front panel and the front portion of the cover to maintain the sealing strip 60 tightly squeezed between the box and the cover for making the coffin air tight and water proof.

Figure 10:
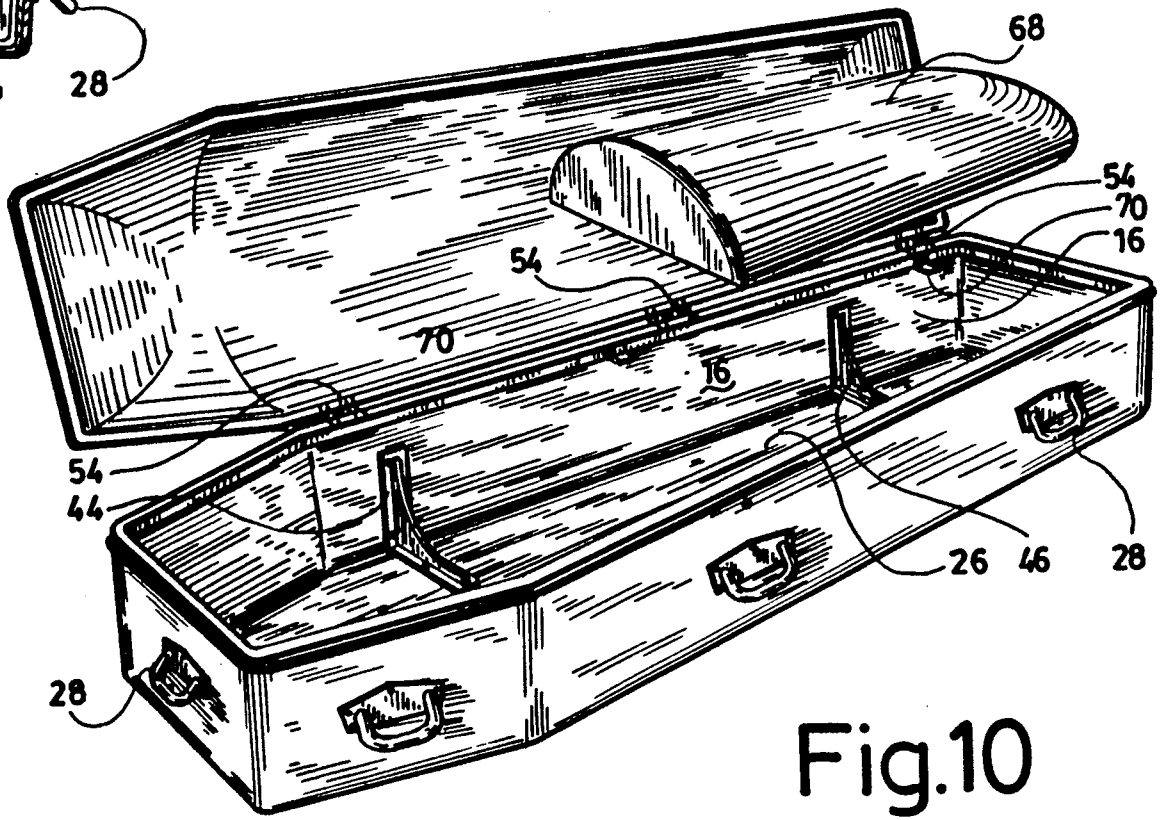
FIG. 10 is a perspective view of the coffin in an opened position.

As stated above, the combined layer of fiberglass and balsa will prevent the lateral walls from curving outwardly when a cadaver rests on the bottom wall 26. However, the lateral walls are preferably angularly shaped such as shown in FIGS. 2 and 10 in order to reduce the dimensions of the coffin at both ends while allowing greater width across the shoulder section of the cadaver.

The box is generally dimensioned with both end walls having lengths between 25 and 30 inches while the box extends over a length of about 79 inches. The length is approximately divided into two tapering sections of about 58 and 21 inches long. The total height of the coffin is about 21 inches divided into, that is, 13½ inch for the height of the box and 7½ inch for the height of the cover.

It is pointed out that a second fiberglass mat can be added over the balsa layer to provide additional rigidity to the coffin.

The fiber mat generally used for the present invention has a weight of about 1½ ounce per square yard.

I claim:

1. A coffin comprising an elongated box made exclusively of a continuous and uninterrupted body having a bottom wall, lateral walls and two end walls, said walls displaying substantially flat surfaces, said lateral and end walls extending perpendicularly from said bottom wall, all of said walls being made of a continuous and uninterrupted first molded layer of a hardened plastified fiber mat and a continuous and uninterrupted second layer, inside said first layer, made of a hardened end-grain balsa core panel, a pair of squares secured to each lateral wall and to an adjacent portion of the bottom wall, said squares being spacedly mounted and adapted to maintain the right angular relationship between the lateral walls and the bottom wall, and to maintain a predetermined periphery for the box, at least two handles secured outwardly on each of said lateral walls, an arch-shaped cover hingedly mounted on one of said lateral walls, said cover peripherally corresponding to the box, whereby the rigidity of the walls and the squares are adapted to maintain the correspondence of the periphery of the box and of the cover when a cadaver is lying in the box.

2. A coffin as recited in claim 1, wherein said mat is made of fiberglass reinforced polyester.

3. A coffin as recited in claim 1, wherein said balsa panel is reinforced with an uninterrupted layer selected from unsaturated polyester and epoxy resin.

4. A coffin as recited in claim 1, wherein said walls are exteriorly covered with an isophtalic resin.

5. A coffin as recited in claim 1, comprising an inner third layer adhesively deposited on said balsa panel, said third layer comprising a plastified fiber mat.

6. A coffin as recited in claim 2, wherein said squares are narrow and made of two flat plates and a trianguloid linking plate connecting the flat plates. Said flat plates being secured to one of the lateral walls and to the bottom wall.

7. A coffin as recited in claim 6, wherein said squares are made of metal and said flat plates have a length of about 5 to 12 inches, and said linking plate having a concave outline, both ends of said outline generally meeting asymptotically with the flat plates.

8. A coffin as recited in claim 7, comprising a sealing strip between the periphery of the box and the cover, at least two hinges internally secured to one of the lateral walls and to the cover for pivotally opening said cover, and means for locking said cover to said box along the lateral wall opposite said one wall, whereby the locking of said cover on the box tightly seals the box.

9. A coffin as recited in claim 1, wherein the lateral panels are formed by two sections angularly disposed between both end walls.

10. A method for making a box for a coffin from a mold having a continuous and uninterrupted inner surface corresponding to the exterior shape of the box, said method comprises, covering said inner surface with an isophtalic resin, depositing on said isophtalic resin an uninterrupted fiber mat dipped into a curable resin, depositing on said mat, an uninterrupted end-grain balsa core panel covering said panel, letting sufficient time to allow the curable resin to be hardened, and removing said mold from said box.

11. A coffin as recited in claim 10, wherein said resin is selected from epoxy and polyester.

12. A coffin comprising an elongated box made exclusively of a continuous and uninterrupted body having a bottom wall, lateral walls and two end walls, said walls displaying substantially flat surfaces, said lateral and end walls extending perpendicularly from said bottom wall, all of said walls being made of a continuous and uninterrupted first molded layer of a hardened plastified fiber mat and a continuous and uninterrupted second layer inside said first layer, made of a hardened end-grain balsa core panel.

* * * * *